US007993543B2

(12) United States Patent
Tagawa et al.

(10) Patent No.: US 7,993,543 B2
(45) Date of Patent: Aug. 9, 2011

(54) REFRIGERATING MACHINE OIL FOR CARBON DIOXIDE REFRIGERANT

(75) Inventors: Kazuo Tagawa, Yokohama (JP); Ken Sawada, Yokohama (JP); Yuji Shimomura, Yokohama (JP); Katsuya Takigawa, Yokohama (JP); Jiro Hashimoto, Wakayama (JP); Masataka Negishi, Wakayama (JP)

(73) Assignees: Nippon Oil Corporation, Tokyo (JP); Kao Corporation, Tokyo (JP)

( * ) Notice: Subject to any disclaimer, the term of this patent is extended or adjusted under 35 U.S.C. 154(b) by 253 days.

(21) Appl. No.: 12/293,846

(22) PCT Filed: Mar. 20, 2007

(86) PCT No.: PCT/JP2007/055727

§ 371 (c)(1),
(2), (4) Date: Mar. 13, 2009

(87) PCT Pub. No.: WO2007/108484

PCT Pub. Date: Sep. 27, 2007

(65) Prior Publication Data

US 2009/0200507 A1 Aug. 13, 2009

(30) Foreign Application Priority Data

Mar. 23, 2006 (JP) ..... P2006-081317
Nov. 24, 2006 (JP) ..... P2006-317560

(51) Int. Cl.
*C09K 5/04* (2006.01)

(52) U.S. Cl. ..... 252/68

(58) Field of Classification Search ..... 252/68
See application file for complete search history.

(56) References Cited

U.S. PATENT DOCUMENTS 4,104,232 A * 8/1978 Inagaki et al. ..... 524/311
5,916,854 A * 6/1999 Inaya et al. ..... 508/452

FOREIGN PATENT DOCUMENTS

| | | |
|---|---|---|
| EP | 0 632 124 | 1/1995 |
| EP | 1 008 643 | 6/2000 |
| GB | 1441918 | 7/1976 |
| GB | 1444826 | 8/1976 |

(Continued)

OTHER PUBLICATIONS

European Search Report dated Jul. 15, 2010.

*Primary Examiner* — John R Hardee
(74) *Attorney, Agent, or Firm* — Finnegan, Henderson, Farabow, Garrett & Dunner, LLP

(57) ABSTRACT

The base oil for the refrigerating machine oil used with a carbon dioxide refrigerant of the invention is characterized by comprising a complete ester of a fatty acid in which the proportion of C14-C22 branched fatty acid is 40-100% by mole and a polyhydric alcohol. The refrigerating machine oil used with a carbon dioxide refrigerant according to the invention is characterized by comprising the base oil for the refrigerating machine oil used with a carbon dioxide refrigerant according to the invention. The base oil for the refrigerating machine oil used with a carbon dioxide refrigerant and the refrigerating machine oil used with a carbon dioxide refrigerant according to the invention, when used together with a carbon dioxide refrigerant, exhibit excellent stability and electrical insulating properties, and have suitable compatibility with refrigerants while allowing adequate lubricity to be exhibited without increasing the viscosity of the base oil.

6 Claims, 1 Drawing Sheet

FOREIGN PATENT DOCUMENTS

| | | |
|---|---|---|
| JP | 2000-104084 | 4/2000 |
| JP | 2000-169869 | 6/2000 |
| JP | 2001-3069 | 1/2001 |
| JP | 2001-107066 | 4/2001 |
| JP | 2002-129177 | 5/2002 |
| WO | WO 98/50738 | 11/1998 |
| WO | WO 2006/022023 | 3/2006 |

* cited by examiner

REFRIGERATING MACHINE OIL FOR CARBON DIOXIDE REFRIGERANT

CROSS-REFERENCE TO RELATED APPLICATIONS

This application is a national phase application of International Application No. PCT/JP2007/055727, filed Mar. 20, 2007, and claims the priority of Japanese Application Nos. 2006-081317, filed Mar. 23, 2006, and 2006-317560, filed Nov. 24, 2006, the contents of all of which are incorporated herein by reference.

TECHNICAL FIELD

The present invention relates to a refrigerating machine oil used in refrigerating air conditioners that employ a carbon dioxide (carbon dioxide gas, $CO_2$) refrigerant.

BACKGROUND ART

In light of the problem of ozone layer depletion in recent years, restrictions on CFCs (chlorofluorocarbons) and HCFCs (hydrochlorofluorocarbons) used as refrigerants in conventional refrigerating machines have become more stringent, and HFCs (hydrofluorocarbons) are coming into use as substitute refrigerants. However, HFC refrigerants are also associated with problems such as increased contribution to global warming, and the use of natural refrigerants as substitutes for such fluorocarbon refrigerants is currently being researched. Among such natural refrigerants, carbon dioxide refrigerants are known to be harmless to the environment and highly safe, while also having advantages such as compatibility with oils and mechanical materials and being readily available, and they have also been used as refrigerants for refrigerating machines in the past. Research has also recently begun on their use as refrigerants for automobile air conditioners that employ open type-compressors or closed type-electrical compressors.

Patent document 1 listed below has disclosed a refrigerating machine oil comprising an esteric base oil, as a refrigerating machine oil used with a carbon dioxide refrigerant.

[Patent document 1] Japanese Unexamined Patent Publication No. 2000-104084

DISCLOSURE OF THE INVENTION

Problems to be Solved by the Invention

With the aforementioned conventional refrigerating machine oil employing an esteric base oil, however, the lubricity is not always sufficient under the coexistence with a carbon dioxide refrigerant, and therefore despite satisfactory compatibility with carbon dioxide, significant reduction occurs in the viscosity with dissolution of carbon dioxide (hereinafter also referred to as "dissolved viscosity"), and viscosity sufficient for lubrication of the refrigerating machine cannot be maintained.

One method for maintaining lubricity of refrigerating machine oils may seek to maintain the oil film thickness by increasing the viscosity of the base oil, but this method leads to problems such as reduced handleability and reduced stirring efficiency because of the high viscosity base oil used.

It is an object of the present invention, which has been accomplished in light of the circumstances described above, to provide a base oil for a refrigerating machine oil used with a carbon dioxide refrigerant, and a refrigerating machine oil used with a carbon dioxide refrigerant, which when used together with a carbon dioxide refrigerant exhibit excellent stability and electrical insulating properties, which have suitable compatibility with refrigerants and which allow adequate lubricity to be exhibited without increasing the viscosity of the base oil.

Means for Solving the Problems

In order to achieve the object stated above, the present inventors first examined how to improve the lubricity of esteric refrigerating machine oils in the presence of a carbon dioxide refrigerant, which are considered to present particular difficulty in achieving the aforementioned object. As a result, it was found that the lubricity is not necessarily improved to a satisfactory degree by simply increasing the viscosity of the base oil or limiting the reduction in dissolved viscosity, and that the fatty acid composition of the fatty acid and the polyhydric alcohol ester is an important deciding factor on the lubricity in the presence of a carbon dioxide refrigerant. Upon much further research based on this finding, the present inventors have discovered that the problems described above can be solved by using a fatty acid with a specific fatty acid composition as the constituent fatty acid of the ester and a polyhydric alcohol as the constituent alcohol, and the invention has been completed upon this discovery.

The base oil for the refrigerating machine oil used with a carbon dioxide refrigerant according to the invention is characterized by comprising a complete ester of a fatty acid in which the proportion of C14-C22 branched fatty acid proportion is 40-100% by mole and a polyhydric alcohol (hereinafter also referred to as "polyol ester of the invention").

The base oil for the refrigerating machine oil used with a carbon dioxide refrigerant of the invention preferably comprises a complete ester of the fatty acid in which the proportion of C14-C22 branched fatty acid is 40-100% by mole and the polyhydric alcohol having 2-6 hydroxyl groups. As polyhydric alcohols with 2-6 hydroxyl groups there are preferred one or more selected from among neopentyl glycol, trimethylolpropane, pentaeythritol, di-(trimethylolpropane), tri-(trimethylolpropane) and di-(pentaetytritol).

The proportion of C16-C18 fatty acids of the constituent fatty acids in the complete ester is preferably 40-100% by mole.

The proportion of C16-C18 branched fatty acids of the constituent fatty acids in the complete ester is also preferably 40-100% by mole.

The proportion of C18 branched fatty acids of the constituent fatty acids in the complete ester is preferably 50-100% by mole.

In the base oil for the refrigerating machine oil used with a carbon dioxide refrigerant, the proportion of tertiary carbon atoms among the constituent carbon atoms of the fatty acid of the complete ester is preferably 2% by mass or greater, as determined by $^{13}$C-NMR analysis.

The refrigerating machine oil used with a carbon dioxide refrigerant according to the invention (hereinafter also referred to as "refrigerating machine oil of the invention") is characterized by containing the base oil for the refrigerating machine oil used with a carbon dioxide refrigerant according to the invention (hereinafter also referred to as "base oil of the invention").

The invention Her provides the refrigerating machine oil used with a carbon dioxide refrigerant characterized by comprising a complete ester of a fatty acid in which the proportion of C14-C22 branched fatty acid is 40-100% by mole and a polyhydric alcohol.

Effect of the Invention

As mentioned above, the invention can provide a base oil for a refrigerating machine oil used with a carbon dioxide refrigerant, and a refrigerating machine oil used with a carbon dioxide refrigerant, which when used in the presence of a carbon dioxide refrigerant exhibit excellent stability and electrical insulating properties, which have suitable compatibility with refrigerants and which allow adequate lubricity to be exhibited without increasing the viscosity of the base oil.

EXPLANATION OF SYMBOLS

Figure 1:
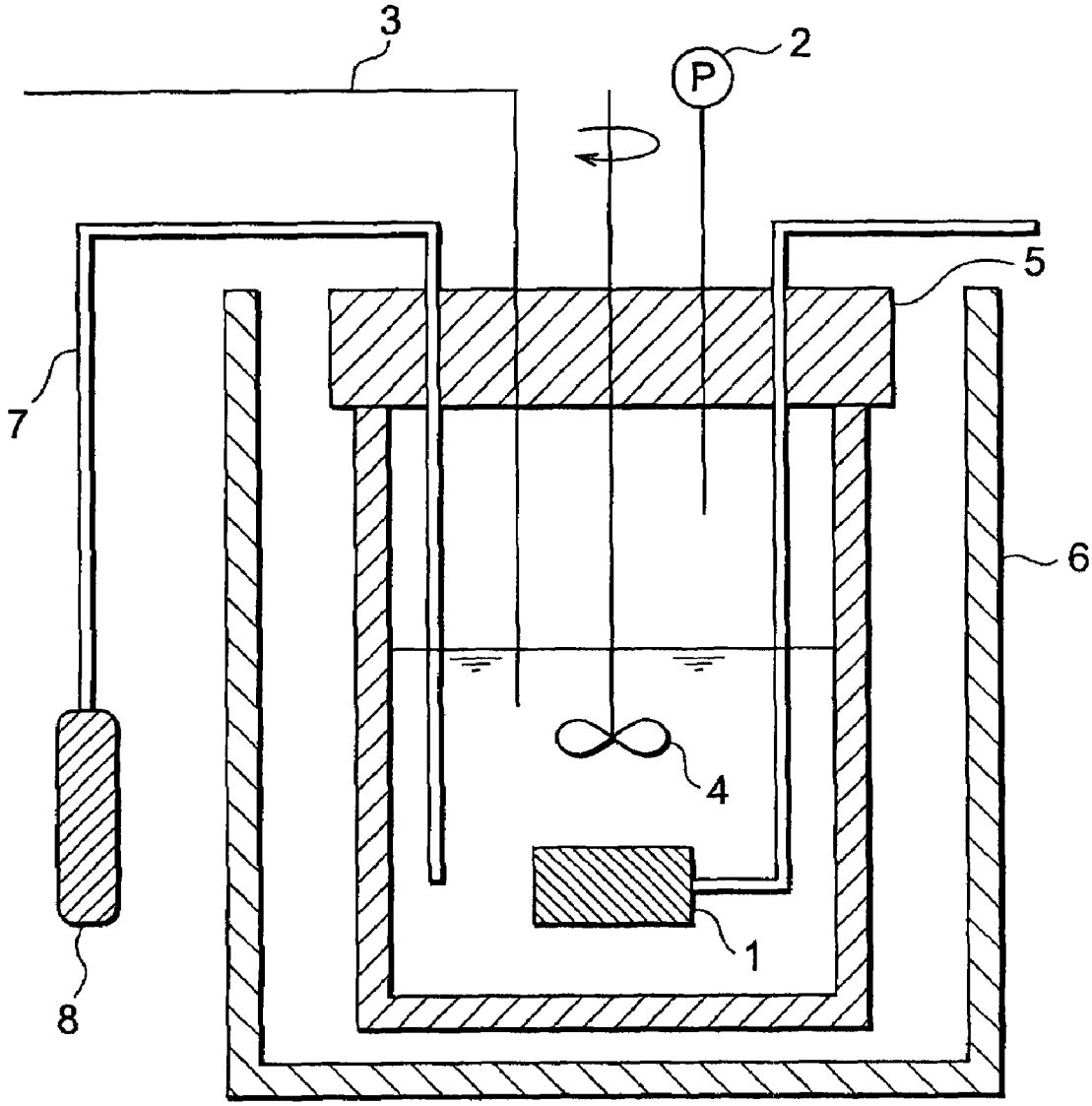
FIG. 1 is a general schematic drawing of an apparatus for measuring refrigerant dissolved viscosity, used for the examples.

1: Viscometer, 2: pressure gauge, 3: thermocouple, 4: stirrer, 5: pressure vessel, 6: thermostatic bath, 7: flow channel, 8: sampling cylinder.

BEST MODE FOR CARRYING OUT THE INVENTION

Preferred embodiments of the invention will now be described in detail.

The base oils of the invention and refrigerating machine oils of the invention have the same physical properties, specific and preferred examples for polyol esters according to the invention contained therein and base oils and additives other than polyol esters according to the invention, as well as combinations thereof. Unless otherwise specified, the explanation regarding refrigerating machine oils of the invention below also applies if the refrigerating machine oil of the invention is a base oil of the invention.

The refrigerating machine oil of the invention contains a polyol ester according to the invention when it contains a base oil of the invention, and when the refrigerating machine oil of the invention includes components other than a polyol ester according to the invention, the refrigerating machine oil of the invention may be prepared using a base oil of the invention which already contains those components, or the refrigerating machine oil may be prepared with addition of those components separately from the base oil of the invention. For example, the refrigerating machine oil of the invention may contain a base oil other than a polyol ester according to the invention, in which case the base oil other than a polyol ester according to the invention may be added to the base oil of the invention beforehand, or it may be added separately as a base oil that does not contain a polyol ester according to the invention (hereinafter also referred to as "second base oil" for convenience) during preparation of the refrigerating machine oil of the invention. Similarly, the refrigerating machine oil of the invention may include various additives, and such additives may either be included in the base oil or second base oil of the invention beforehand or added separately from the refrigerating machine oil or second base oil of the invention during preparation of the refrigerating machine oil of the invention. In addition, the components other than a polyol ester according to the invention in the base oil and refrigerating machine oil of the invention may be derived from the base oil, the second base oil or the additives, without any particular restrictions.

The refrigerating machine oil used with a carbon dioxide refrigerant according to the invention comprises a complete ester of a fatty acid in which the proportion of C14-C22 branched fatty acids is 40-100% by mole and a polyhydric alcohol.

The proportion of C14-C22 branched fatty acids in the fatty acid of the polyol ester of the invention (hereinafter referred to as "constituent fatty acid") is 40-100% by mole as mentioned above, but it is preferably 50-100% by mole and more preferably 60-100% by mole. The proportion of C14-C22 branched fatty acid is less than 40% by mole will result in insufficient lubricity in the presence of a carbon dioxide refrigerant. As C14-C22 branched fatty acids there may be mentioned, specifically, branched tetradecanoic acids, branched pentadecanoic acids, branched hexadecanoic acids, branched heptadecanoic acids, branched octadecanoic acids, branched nonadecanoic acids, branched eicosanoic acids, branched heneicosanoic acid and branched docosanoic acids, among which branched hexadecanoic acids, branched heptadecanoic acids and branched octadecanoic acids are preferred, and branched octadecanoic acids are more preferred.

The constituent fatty acid may consist of only branched fatty acids or may consist of a mixture of branched fatty acids and straight-chain fatty acids, so long as the proportion of C14-C22 branched fatty acid satisfies the condition specified above. The constituent fatty acid may also include branched fatty acids other than C14-C22 branched fatty acids. As examples of fatty acids other than C14-C22 branched fatty acids there may be mentioned C6-C24 straight-chain fatty acids and C6-C13, C23 or C24 branched fatty acids, and more specifically there may be mentioned straight-chain or branched hexanoic acids, straight-chain or branched heptanoic acids, straight-chain or branched octanoic acids, straight-chain or branched nonanoic acids, straight-chain or branched decanoic acids, straight-chain or branched undecanoic acids, straight-chain or branched dodecanoic acids, straight-chain or branched tridecanoic acids, straight-chain tetradecanoic acids, straight-chain pentadecanoic acids, straight-chain hexadecanoic acids, straight-chain heptadecanoic acids, straight-chain octadecanoic acids, straight-chain nonadecanoic acids, straight-chain eicosanoic acids, straight-chain heneicosanoic acids, straight-chain docosanoic acids, straight-chain or branched tricosanoic acids and straight-chain or branched tetracosanoic acids.

The carbon number distribution of the constituent fatty acid is not particularly restricted so long as the proportion of the C14-C22 branched fatty acid satisfies the condition specified above, but from the viewpoint of ensuring satisfactory flow properties and lubricity in the presence of a carbon dioxide refrigerant, the proportion of the C16-C18 fatty acid (including straight-chain fatty acid and branched fatty acid) is preferably 40-100% by mole, more preferably 50-100% by mole, even more preferably 60-100% by mole, yet more preferably 80-100% by mole, even yet more preferably 90-100% by mole and most preferably 95-100% by mole. The proportion of C16-C18 fatty acid proportion is less than 40% by mole will result in reduced lubricity in the presence of a carbon dioxide refrigerant.

From the viewpoint of ensuring satisfactory flow properties and lubricity in the presence of a carbon dioxide refrigerant, the proportion of C16-C18 branched fatty acids in the constituent fatty acid of the polyol ester of the invention is preferably 40-100% by mole, more preferably 50-100% by mole, even more preferably 60-100% by mole, yet more preferably 80-100% by mole, even yet more preferably 90-100% by mole and most preferably 95-100% by mole.

From the viewpoint of ensuring satisfactory flow properties and lubricity in the presence of a carbon dioxide refrigerant, the proportion of C18 branched fatty acids in the constituent fatty acid of the polyol ester of the invention is preferably 50-100% by mole, more preferably 60-100% by mole and even more preferably 70-100% by mole.

The proportion of tertiary carbon atoms among the carbon atoms of the constituent fatty acid in the polyol ester of the invention is preferably 2% by mass or greater, more preferably 2-10% by mass and even more preferably 2.5-5% by mass. The proportion of tertiary carbon atoms can be determined by $^{13}$C-NMR analysis.

The polyhydric alcohol composing the polyol ester of the invention is preferably a polyhydric alcohol with 2-6 hydroxyl groups. From the viewpoint of obtaining a high level of lubricity in the presence of a carbon dioxide refrigerant, it is preferred to use a polyhydric alcohol with 4-6 hydroxyl groups. From the viewpoint of energy efficiency, low viscosity is sometimes desired for refrigerating machine oils used with a carbon dioxide refrigerant, and when a polyhydric alcohol with two or three hydroxyls is used as the polyhydric alcohol composing the polyol ester of the invention it is possible to achieve satisfactory levels of both lubricity and low viscosity in the presence of carbon dioxide refrigerants.

As specific examples of dihydric alcohols (diols) there may be mentioned ethylene glycol, 1,3-propanediol, propylene glycol, 1,4-butanediol, 1,2-butanediol, 2-methyl-1,3-propanediol, 1,5-pentanediol, neopentyl glycol, 1,6-hexanediol, 2-ethyl-2-methyl-1,3-propanediol, 1,7-heptanediol, 2-methyl-2-propyl-1,3-propanediol, 2,2-diethyl-1,3-propanediol, 1,8-octanediol, 1,9-nonanediol, 1,10-decanediol, 1,11-undecanediol, 1,12-dodecanediol and the like. As specific examples of trihydric and greater alcohols there may be mentioned polyhydric alcohols such as trimethylolethane, trimethylolpropane, trimethylolbutane, di-(trimethylolpropane), tri-(trimethylolpropane), pentaerytritol, di-(pentaeydritol), tri-(pentaerytritol), glycerin, polyglycerins (glycerin 2-3mers), 1,3,5-pentanetriol, sorbitol, sorbitan, sorbitol-glycerin condensation products, adonitol, arabitol, xylitol, mannitol and the like, as well as xylose, arabinose, ribose, rhamnose, glucose, fructose, galactose, mannose, sorbose and cellobiose. Particularly preferred among these are hindered alcohols such as neopentyl glycol, trimethylolethane, trimethylolpropane, trimethylolbutane, di-(trimethylolpropane), tri-(trimethylolpropane), pentaerytritol, di-(pentaerytritol) and tri-(pentaeythritol).

For more excellent hydrolytic stability, the polyol ester of the invention is more preferably a complete ester consisting of a hindered alcohol such as neopentyl glycol, trimethylolethane, trimethylolpropane, trimethylolbutane, di-(trimethylolpropane), tri-(trimethylolpropane), pentaerythritol, di-(pentaerythritol) or tri-(pentaerythritol), even more preferably a complete ester consisting of neopentyl glycol, trimethylolethane, trimethylolpropane, trimethylolbutane or pentaerythritol, even more preferably a complete ester consisting of neopentyl glycol, trimethylolpropane or pentaeythritol, and most preferably a complete ester consisting of pentaerythritol, because of its especially superior compatibility with refrigerants and hydrolytic stability.

The polyol ester of the invention may consist of one type of polyol ester with a single structure, or it may be a mixture of polyol esters with different structures.

The polyol ester of the invention may be a complete ester of one fatty acid and one polyhydric alcohol, a complete ester of two or more fatty acids and one polyhydric alcohol, a complete ester of one fatty acid and two or more polyhydric alcohols, or a complete ester of two or more fatty acids and two or more polyhydric alcohols. Of these, polyol esters employing mixed fatty acids and especially polyol esters comprising two or more fatty acids in the complete ester molecule, have low-temperature characteristics and excellent compatibility with refrigerants.

The polyol ester of the invention is a complete ester obtained by esterification of all of the hydroxyl groups of a polyhydric alcohol, but the refrigerating machine oil used with a carbon dioxide refrigerant according to the invention may also contain a partial ester of a polyhydric alcohol and a fatty acid with a C14-C22 branched fatty acid proportion of 40-100% by mole, so long as the excellent effect of the polyol ester of the invention is not impaired. A partial ester is a polyol ester having some of the hydroxyl groups of the polyhydric alcohol remaining as hydroxyl groups without esterification. The partial ester may also exist as a by-product of synthesis of the polyol ester of the invention. The purity of a polyol ester of the invention obtained by synthesis is specified by the hydroxyl value of the synthesis product, and the hydroxyl value is preferably not greater than 20 mgKOH/g, more preferably not greater than 10 mgKOH/g and even more preferably not greater than 5 mgKOH/g.

The refrigerating machine oil used with a carbon dioxide refrigerant according to the invention may consist entirely of a polyol ester of the invention, or it may also contain a base oil other than the polyol ester. As base oils other than polyol ester of the invention there may be used hydrocarbon-based oils including mineral oils, olefin polymers, naphthalene compounds, alkylbenzenes and the like, esteric base oils other than polyol esters of the invention (monoesters, and polyol esters containing only straight-chain fatty acids as constituent fatty acids), and oxygen-containing synthetic oils such as polyglycols, polyvinyl ethers, ketones, polyphenyl ethers, silicones, polysiloxanes and perfluoroethers. Preferred oxygen-containing synthetic oils among these are polyglycols, polyvinyl ethers and ketones.

The refrigerating machine oil used with a carbon dioxide refrigerant according to the invention is not particularly restricted in regard to the content of the polyol ester of the invention, but for more excellent performance including lubricity, refrigerant compatibility, heat and chemical stability and electrical insulating properties and the like, the content is preferably 10% by mass or greater, more preferably 20% by mass or greater, even more preferably 30% by mass or greater, yet more preferably 40% by mass or greater and most preferably 50% by mass or greater, based on the total amount of the refrigerating machine oil. The content of complete esters in the base oil for the refrigerating machine oil used with a carbon dioxide refrigerant according to the invention is preferably selected so that the content of polyol esters according to the invention based on the total amount of refrigerating machine oil satisfies the conditions specified above when the base oil is used in a refrigerating machine oil.

The refrigerating machine oil used with a carbon dioxide refrigerant according to the invention comprises a base oil for the refrigerating machine oil used with a carbon dioxide refrigerant according to the invention, and because the base oil contains the polyol ester of the invention it may be satisfactorily used without addition of additives, although various additives may be combined therewith if necessary.

In order to further enhance the abrasion resistance and load resistance of the refrigerating machine oil used with a carbon dioxide refrigerant according to the invention there may be added one or more phosphorus compounds selected from the group consisting of phosphoric acid esters, acidic phosphoric acid esters, thiophosphoric acid esters, acidic phosphoric acid ester amine salts, chlorinated phosphoric acid esters and phosphorous acid esters. These phosphorus compounds are esters consisting of phosphoric acids or phosphorous acid with alkanols or polyether type-alcohols, or derivatives thereof.

As specific examples of phosphoric acid esters there may be mentioned tributyl phosphate, tripentyl phosphate, trihexyl phosphate, triheptyl phosphate, trioctyl phosphate, trinonyl phosphate, tridecyl phosphate, triundecyl phosphate, tridodecyl phosphate, tritridecyl phosphate, tritetradecyl phosphate, tripentadecyl phosphate, trihexadecyl phosphate, triheptadecyl phosphate, trioctadecyl phosphate, trioleyl phosphate, triphenyl phosphate, tricresyl phosphate, trixylenyl phosphate, cresyldiphenyl phosphate and xylenyldiphenyl phosphate.

As acidic phosphoric acid esters there may be mentioned monobutyl acid phosphate, monopentyl acid phosphate, monohexyl acid phosphate, monoheptyl acid phosphate, monooctyl acid phosphate, monononyl acid phosphate, monodecyl acid phosphate, monoundecyl acid phosphate, monododecyl acid phosphate, monotridecyl acid phosphate, monotetradecyl acid phosphate, monopentadecyl acid phosphate, monohexadecyl acid phosphate, monoheptadecyl acid phosphate, monooctadecyl acid phosphate, monooleyl acid phosphate, dibutyl acid phosphate, dipentyl acid phosphate, dihexyl acid phosphate, diheptyl acid phosphate, dioctyl acid phosphate, dinonyl acid phosphate, didecyl acid phosphate, diundecyl acid phosphate, didodecyl acid phosphate, ditridecyl acid phosphate, ditetradecyl acid phosphate, dipentadecyl acid phosphate, dihexadecyl acid phosphate, diheptadecyl acid phosphate, dioctadecyl acid phosphate and dioleyl acid phosphate.

As thiophosphoric acid esters there may be mentioned tributyl phosphorothionate, tripentyl phosphorothionate, trihexyl phosphorothionate, triheptyl phosphorothionate, trioctyl phosphorothionate, trinonyl phosphorothionate, tridecyl phosphorothionate, triundecyl phosphorothionate, tridodecyl phosphorothionate, tritridecyl phosphorothionate, tritetradecyl phosphorothionate, tripentadecyl phosphorothionate, trihexadecyl phosphorothionate, triheptadecyl phosphorothionate, trioctadecyl phosphorothionate, trioleyl phosphorothionate, triphenyl phosphorothionate, tricresyl phosphorothionate, trixylenyl phosphorothionate, cresyldiphenyl phosphorothionate and xylenyldiphenyl phosphorothionate.

As acidic phosphoric acid ester amine salts there may be mentioned amine salts of amines, such as methylamines, ethylamines, propylamines, butylamines, pentylamines, hexylamines, heptylamines, octylamines, dimethylamines, diethylamines, dipropylamines, dibutylamines, dipentylamines, dihexylamines, diheptylamines, dioctylamines, trimethylamines, triethylamines, tripropylamines, tributylamines, tripentylamines, trihexylamines, triheptylamines and trioctylamines, with the aforementioned acidic phosphoric acid esters.

As chlorinated phosphoric acid esters there may be mentioned tris-dichloropropyl phosphate, tris-chloroethyl phosphate, tris-chlorophenyl phosphate and polyoxyalkylene-bis [di(chloroalkyl)] phosphate. As phosphorous acid esters there may be mentioned dibutyl phosphite, dipentyl phosphite, dihexyl phosphite, diheptyl phosphite, dioctyl phosphite, dinonyl phosphite, didecyl phosphite, diundecyl phosphite, didodecyl phosphite, dioleyl phosphite, diphenyl phosphite, dicresyl phosphite, tributyl phosphite, tripentyl phosphite, trihexyl phosphite, triheptyl phosphite, trioctyl phosphite, trinonyl phosphite, tridecyl phosphite, triundecyl phosphite, tridodecyl phosphite, trioleyl phosphite, triphenyl phosphite and tricresyl phosphite. Mixtures of the above compounds may also be used.

When the refrigerating machine oil used with a carbon dioxide refrigerant according to the invention contains such phosphorus compounds, the phosphorus compound content is not particularly restricted but is preferably 0.01-5.0% by mass and more preferably 0.02-3.0% by mass based on the total amount of the refrigerating machine oil (the total amount of the base oil and all of the additives). A phosphorus compound may be used alone or two or more may be used in combination.

In order to further improve the stability of the refrigerating machine oil used with a carbon dioxide refrigerant according to the invention, it may contain one or more epoxy compounds selected from among phenylglycidyl ether-type epoxy compounds, alkylglycidyl ether-type epoxy compounds, glycidyl ester-type epoxy compounds, allyloxirane compounds, alkyloxirane compounds, alicyclic epoxy compounds, epoxidated fatty acid monoesters and epoxidated vegetable oils.

Specific examples of phenylglycidyl ether-type epoxy compounds include phenylglycidyl ether and alkylphenylglycidyl ether. The alkylphenylglycidyl ether may have one to three C1-C13 alkyl groups, and preferably one C4-10 alkyl group such as n-butylphenylglycidyl ether, i-butylphenylglycidyl ether, sec-butylphenylglycidyl ether, tert-butylphenylglycidyl ether, pentylphenylglycidyl ether, hexylphenylglycidyl ether, heptylphenylglycidyl ether, octylphenylglycidyl ether, nonylphenylglycidyl ether or decylphenylglycidyl ether.

Specific examples of alkylglycidyl ether-type epoxy compounds include decylglycidyl ether, undecylglycidyl ether, dodecylglycidyl ether, tridecylglycidyl ether, tetradecylglycidyl ether, 2-ethylhexylglycidyl ether, neopentyl glycol diglycidyl ether, trimethylolpropanetriglycidyl ether, pentaerythritoltetraglycidyl ether, 1,6-hexanediol diglycidyl ether, sorbitolpolyglycidyl ether, polyalkyleneglycol monoglycidyl ether and polyalkyleneglycol diglycidyl ether.

Specific examples of glycidyl ester-type epoxy compounds include phenylglycidyl esters, alkylglycidyl esters and alkenylglycidyl esters, among which glycidyl-2,2-dimethyloctanoate, glycidylbenzoate, glycidyl acrylate and glycidyl methacrylate are preferred.

Specific examples of allyloxirane compounds include 1,2-epoxystyrene and alkyl-1,2-epoxystyrenes.

Specific examples of alkyloxirane compounds include 1,2-epoxybutane, 1,2-epoxypentane, 1,2-epoxyhexane, 1,2-epoxyheptane, 1,2-epoxyoctane, 1,2-epoxynonane, 1,2-epoxydecane, 1,2-epoxyundecane, 1,2-epoxydodecane, 1,2-epoxytridecane, 1,2-epoxytetradecane, 1,2-epoxypentadecane, 1,2-epoxyhexadecane, 1,2-epoxyheptadecane, 1,1,2-epoxyoctadecane, 2-epoxynonadecane and 1,2-epoxyeicosane.

Specific examples of alicyclic epoxy compounds include 1,2-epoxycyclohexane, 1,2-epoxycyclopentane, 3,4-epoxycyclohexylmethyl-3,4-epoxycyclohexane carboxylate, bis(3,4-epoxycyclohexylmethyl)adipate, exo-2,3-epoxynorbornane, bis(3,4-epoxy-6-methylcyclohexylmethyl)adipate, 2-(7-oxabicyclo[4.1.0]hept-3-yl)-spiro(1,3-dioxane-5,3'-[7]oxabicyclo[4.1.0]heptane, 4-(1'-methylepoxyethyl)-1,2-epoxy-2-methylcyclohexane and 4-epoxyethyl-1,2-epoxycyclohexane.

Specific examples of epoxidated fatty acid monoesters include epoxidated esters of C12-C20 fatty acids and C1-C8 alcohols, phenol or alkylphenols. Particularly preferred for use are butyl, hexyl, benzyl, cyclohexyl, methoxyethyl, octyl, phenyl and butylphenyl esters of epoxystearic acids.

Specific examples of epoxidated vegetable oils include epoxy compounds of vegetable oils such as soybean oil, linseed oil and cottonseed oil.

Preferred among these epoxy compounds are phenylglycidyl ether-type epoxy compounds, glycidyl ester-type epoxy compounds, alicyclic epoxy compounds and epoxidated fatty acid monoesters. More preferred among these are phenylglycidyl ether-type epoxy compounds and glycidyl ester-type epoxy compounds, and phenylglycidyl ether, butylphenylglycidyl ether, alkylglycidyl ester or mixtures thereof being especially preferred.

When the refrigerating machine oil used with a carbon dioxide refrigerant according to the invention contains such epoxy compounds, the epoxy compound content is not particularly restricted but is preferably 0.1-5.0% by mass and more preferably 0.2-2.0% by mass based on the total amount of the refrigerating machine oil. Such an epoxy compound may be used alone, or two or more may be used in combination.

If necessary in order to further enhance the performance of the refrigerating machine oil used with a carbon dioxide refrigerant according to the invention, it may contain refrigerating machine oil additives that are known in the prior art. As examples of such additives there may be mentioned phenol-based antioxidants such as di-tert-butyl-p-cresol and bisphenol A, amine-based antioxidants such as phenyl-α-naphthylamine and N,N-di(2-naphthyl)-p-phenylenediamine, anti-wear agents such as zinc dithiophosphate, extreme-pressure agents such as chlorinated paraffins and sulfur compounds, oiliness improvers such as fatty acids, silicone-based and other types of antifoaming agents, metal deactivators such as benzotriazoles, viscosity index improvers, pour point depressants, detergent dispersants and the like. Such additives may be used alone or in combinations of two or more. There are no particular restrictions on the content of such additives, but it is preferably not greater than 10% by mass and more preferably not greater than 5% by mass based on the total amount of the refrigerating machine oil.

The kinematic viscosity of the refrigerating machine oil used with a carbon dioxide refrigerant according to the invention is not particularly restricted, but the kinematic viscosity at 40° C. is preferably 3-1000 $mm^2/s$, more preferably 4-500 $mm^2/s$ and most preferably 5-400 $mm^2/s$. The kinematic viscosity at 100° C. is preferably 1-100 $mm^2/s$ and more preferably 2-50 $mm^2/s$.

The volume resistivity of the refrigerating machine oil used with a carbon dioxide refrigerant according to the invention is also not particularly restricted, but is preferably $1.0\times10^{12}$ Ω·cm or greater, more preferably $1.0\times10^{13}$ Ω·cm or greater and most preferably $1.0\times10^{14}$ Ω·cm or greater. Electrical insulating properties will usually be required for use in refrigerating machines with hermetic type compressor. According to the invention, the volume resistivity is the value measured according to JIS C 2101, "Electrical Insulation Oil Test Method", at 25° C.

The moisture content of the refrigerating machine oil used with a carbon dioxide refrigerant according to the invention is not particularly restricted but is preferably not greater than 200 ppm, more preferably not greater than 100 ppm and most preferably not greater than 50 ppm based on the total amount of the refrigerating machine oil. A lower moisture content is desired from the viewpoint of effect on the stability and electrical insulating properties of the oil, especially for use in refrigerating machines with hermetic type compressor.

The acid value of the refrigerating machine oil used with a carbon dioxide refrigerant according to the invention is also not particularly restricted, but in order to prevent corrosion of metals used in the refrigerating machine or pipings, and in order to prevent decomposition of the ester oil in the refrigerating machine oil used with a carbon dioxide refrigerant according to the invention, it is preferably not greater than 0.1 mgKOH/g and more preferably not greater than 0.05 mgKOH/g. The acid value according to the invention is the value measured based on JIS K 2501, "Petroleum Products and Lubricants—Determination of Neutralization Number".

The ash content of the refrigerating machine oil used with a carbon dioxide refrigerant according to the invention is not particularly restricted, but in order to increase the stability of the refrigerating machine oil used with a carbon dioxide refrigerant according to the invention and inhibit generation of sludge, it is preferably not greater than 100 ppm and more preferably not greater than 50 ppm. According to the invention, the ash content is the value measured based on JIS K 2272, "Crude Oil and Petroleum Products—Determination of Ash and Sulfate Ash".

The refrigerating machine oil used with a carbon dioxide refrigerant according to the invention exhibits an excellent effect when used with a carbon dioxide refrigerant, and the refrigerant used may be a single carbon dioxide refrigerant or a mixed refrigerant comprising a carbon dioxide refrigerant and another refrigerant. As other refrigerants there may be mentioned MFC refrigerants, fluorinated ether-based refrigerants such as perfluoroethers, dimethyl ether, ammonia, hydrocarbons and the like.

As HFC refrigerants there may be mentioned C1-C3 and preferably C1-C2 hydrofluorocarbons. As specific examples there may be mentioned HFCs such as difluoromethane (HFC-32), trifluoromethane (HFC-23), pentafluoroethane (HFC-125), 1,1,2,2-tetrafluoroethane (HFC-134), 1,1,1,2-tetrafluoroethane (HFC-134a), 1,1,1-trifluoroethane (HFC-143a) and 1,1-difluoroethane (HFC-152a), as well as mixtures of two or more of the above. These refrigerants may be appropriately selected according to the purpose of use and the required performance, such as HFC-32 alone; HFC-23 alone; HFC-134a alone; HFC-125 alone; a mixture of HFC-134a/HFC-32=60-80% by mass/40-20% by mass; a mixture of HFC-32/HFC-125=40-70% by mass/60-30% by mass; a mixture of HFC-125/HFC-143a=40-60% by mass/60-40% by mass; a mixture of HFC-134a/HFC-32/HFC-125=60% by mass/30% by mass/10% by mass; a mixture of HFC-134a/HFC-32/HFC-125=40-70% by mass/15-35% by mass/5-40% by mass; or a mixture of HFC-125/HFC-134a/HFC-143a=35-55% by mass/1-15% by mass/40-60% by mass. More specifically, there may be mentioned a mixture of HFC-134a/HFC-32=70/30% by mass; a mixture of HFC-32/HFC-125=60/40% by mass; a mixture of HFC-32/HFC-125=50/50% by mass (R410A); a mixture of HFC-32/HFC-125=45/55% by mass (R410B); a mixture of HFC-125/HFC-143a=50/50% by mass (R507c); a mixture of HFC-32/HFC-125/HFC-134a=30/10/60% by mass; a mixture of HFC-32/HFC-125/HFC-134a=23/25/52% by mass (R407c); a mixture of HFC-32/HFC-125/HFC-134a=25/15/60% by mass (R407E); and a mixture of HFC-125/HFC-134a/HFC-143a=44/4/52% by mass (R404A).

As specific examples of fluorinated ether-based refrigerants there may be mentioned HFE-134p, HFE-245mc, HFE-236mf, HFE-236me, HEFE-338mcf, HFE-365mcf, BFE-245mf, HFE-347mmy, HFE-347mcc, BFE-125, HFE-143m, BFE-227me and the like.

As hydrocarbon refrigerants there are preferably used those that are gases at 25° C., under 1 atmosphere. More specifically preferred are C1-C5 and preferably C1-C4 alkanes, cycloalkanes and alkenes, and their mixtures. Specific examples thereof include methane, ethylene, ethane, propylene, propane, cyclopropane, butane, isobutane, cyclobutane, methylcyclopropane and mixtures of two or more of the above. Preferred among the above are propane, butane, isobutane and their mixtures.

There are no particular restrictions on the mixing ratio of the carbon dioxide refrigerant with an HFC refrigerant, fluorinated ether-based refrigerant, dimethyl ether or ammonia, but the total amount of refrigerant used with the carbon dioxide refrigerant is preferably 1-200 parts by mass and more preferably 10-100 parts by mass with respect to 100 parts by mass of the carbon dioxide. As a preferred mode, there may be mentioned a mixed refrigerant comprising a mixture of a carbon dioxide refrigerant and a hydrofluorocarbon and/or hydrocarbon, at preferably 1-200 parts by mass and more preferably 10-100 parts by mass as the total of hydrofluorocarbon/hydrocarbon with respect to 100 parts by mass of the carbon dioxide.

The refrigerating machine oil used with a carbon dioxide refrigerant according to the invention will normally be used in a refrigerating air conditioner in the form of a refrigerating machine fluid composition comprising which is mixed with a carbon dioxide-containing refrigerant such as described above. The mixing proportion of the refrigerating machine oil and refrigerant in the composition is not particularly restricted, but the refrigerating machine oil content is preferably 1-500 parts by mass and more preferably 2-400 parts by mass with respect to 100 parts by mass of the refrigerant.

The refrigerating machine oil used with a carbon dioxide refrigerant according to the invention has excellent electrical characteristics and low hygroscopicity, and is therefore suitable for use in room air conditioners, package air conditioners and refrigerators having reciprocating or rotating hermetic type compressors. The refrigerating machine oil used with a carbon dioxide refrigerant according to the invention may also be suitably used in cooling devices of automobile air conditioners, dehumidifiers, water heater, freezer, cold storage/refrigerated warehouses, automatic vending machines, showcases, chemical plants and the like. The refrigerating machine oil used with a carbon dioxide refrigerant according to the invention may, in addition, be suitably used in apparatuses with centrifugal compressors.

EXAMPLES

The present invention will now be explained in greater detail based on examples and comparative examples, with the understanding that these examples are in no way limitative on the invention.

[Compositions of Fatty Acids A and B]

The compositions of fatty acids A and B used in the examples are listed in Table 1.

TABLE 1

| | Carbon numbers in fatty acid | Fatty acid A Straight-chain fatty acids | Fatty acid A Branched fatty acids | Fatty acid B Straight-chain fatty acids | Fatty acid B Branched fatty acids |
|---|---|---|---|---|---|
| Fatty acid composition (% by mole) | 12 | 1.4 | 0.0 | 0.0 | 0.0 |
| | 14 | 2.0 | 0.2 | 1.2 | 1.2 |
| | 15 | 0.7 | 0.0 | 0.0 | 0.0 |
| | 16 | 6.8 | 4.6 | 6.6 | 7.7 |
| | 18 | 3.0 | 74.1 | 2.5 | 65.4 |
| | 19 | 0.0 | 0.0 | 2.2 | 0.0 |
| | 20 | 0.0 | 0.0 | 0.5 | 0.0 |
| | 22 | 0.0 | 0.0 | 0.0 | 0.0 |
| | Other fatty acids | 7.2 | | 12.7 | |
| Proportion of C14-C22 Branched fatty acid (% by mole) | | 78.9 | | 74.3 | |
| Proportion of C16-C18 Branched fatty acid (% by mole) | | 78.7 | | 73.1 | |

Examples 1-23

Comparative Examples 1-16

For Examples 1-23 and Comparative Examples 1-16, refrigerating machine oils were prepared using base oils 1-39 listed below. The properties of the obtained refrigerating machine oils are shown in Tables 2-6.

(Base Oils)

Base oil 1: Ester of fatty acid A and neopentyl glycol (complete ester content based on total amount of base oil: 95% by mass or greater, hydroxyl value: 5 mgKOH/g or less)

Base oil 2: Ester of fatty acid B and neopentyl glycol (complete ester content based on total amount of base oil: 95% by mass or greater, hydroxyl value: 5 mgKOH/g or less)

Base oil 3: Ester of mixed fatty acid comprising fatty acid A and n-decanoic acid (mixing ratio (mass ratio): fatty acid A/n-decanoic acid=85/15) and neopentyl glycol (complete ester content based on total amount of base oil: 95% by mass or greater, hydroxyl value: 5 mgKOH/g or less).

Base oil 4: Ester of mixed fatty acid comprising fatty acid A and 3,5,5-trimethylhexanoic acid (mixing ratio (mass ratio): fatty acid A/3,5,5-trimethylhexanoic acid=85/15) and neopentyl glycol (complete ester content based on total amount of base oil: 95% by mass or greater, hydroxyl value: 5 mgKOH/g or less).

Base oil 5: Ester of C16-C18 mixed fatty acid (proportion of C18 branched fatty acids in total mixed fatty acid: 50% by mole, proportion of tertiary carbon atoms among constituent carbon atoms of fatty acid: 2.9% by mass) and trimethylolpropane (complete ester content based on total amount of base oil: 95% by mass, hydroxyl value: 5 mgKOH/g or less).

Base oil 6: Ester of fatty acid A and trimethylolpropane (complete ester content based on total amount of base oil: 95% by mass or greater, hydroxyl value: 5 mgKOH/g or less)

Base oil 7: Ester of fatty acid B and trimethylolpropane (complete ester content based on total amount of base oil: 95% by mass or greater, hydroxyl value: 5 mgKOH/g or less)

Base oil 8: Ester of mixed fatty acid comprising fatty acid A and n-decanoic acid (mixing ratio (mass ratio): fatty acid A/n-decanoic acid=85/15) and trimethylolpropane (complete ester content based on total amount of base oil: 95% by mass or greater, hydroxyl value: 5 mgKOH/g or less).

Base oil 9: Ester of mixed fatty acid comprising fatty acid A and 3,5,5-trimethylhexanoic acid (mixing ratio (mass ratio): fatty acid A/3,5,5-trimethylhexanoic acid=85/15) and trimethylolpropane (complete ester content based on total amount of base oil: 95% by mass or greater, hydroxyl value: 5 mgKOH/g or less).

Base oil 10: Ester of C16-C18 mixed fatty acid (proportion of C18 branched fatty acids in total mixed fatty acid: 50% by mole, proportion of tertiary carbon atoms among constituent carbon atoms of fatty acid: 2.9% by mass) and pentaerythritol (complete ester content based on total amount of base oil: 95% by mass or greater, hydroxyl value: 5 mgKOH/g or less).

Base oil 11: Ester of C16-C18 mixed fatty acid (proportion of C18 branched fatty acids in total mixed fatty acid: 50% by mole, proportion of tertiary carbon atoms among constituent carbon atoms of fatty acid: 2.9% by mass) and di-(pentaerythritol) (complete ester content based on total amount of base oil: 95% by mass or greater, hydroxyl value: 5 mgKOH/g or less).

Base oil 12: Ester of fatty acid A and di-(trimethylolpropane) (complete ester content based on total amount of base oil: 95% by mass or greater, hydroxyl value: 5 mgKOH/g or less)

Base oil 13: Ester of fatty acid A and pentaerythritol (complete ester content based on total amount of base oil: 95% by mass or greater, hydroxyl value: 5 mgKOH/g or less)

Base oil 14: Ester of fatty acid A and di-(pentaerythritol) (complete ester content based on total amount of base oil: 95% by mass or greater, hydroxyl value: 5 mgKOH/g or less)

Base oil 15: Ester of fatty acid B and di-(trimethylolpropane) (complete ester content based on total amount of base oil: 95% by mass or greater, hydroxyl value: 5 mgKOH/g or less)

Base oil 16: Ester of fatty acid B and pentaerythritol (complete ester content based on total amount of base oil: 95% by mass or greater, hydroxyl value: 5 mgKOH/g or less)

Base oil 17: Ester of fatty acid B and di-(pentaerythritol) (complete ester content based on total amount of base oil: 95% by mass or greater, hydroxyl value: 5 mgKOH/g or less)

Base oil 18: Ester of mixed fatty acid comprising fatty acid A and n-decanoic acid (mixing ratio (mass ratio): fatty acid A/n-decanoic acid=85/15) and pentaerythritol (complete ester content based on total amount of base oil: 95% by mass or greater, hydroxyl value: 5 mgKOH/g or less).

Base oil 19: Ester of mixed fatty acid comprising fatty acid A and 3,5,5-trimethylhexanoic acid (mixing ratio (mass ratio): fatty acid A/3,5,5-trimethylhexanoic acid=85/15) and pentaerythritol (complete ester content based on total amount of base oil: 95% by mass or greater, hydroxyl value: 5 mgKOH/g or less).

Base oil 20: Ester of mixed fatty acid comprising fatty acid A and n-decanoic acid (mixing ratio (mass ratio): fatty acid A/n-decanoic acid=70/30) and pentaerythritol (complete ester content based on total amount of base oil: 95% by mass or greater, hydroxyl value: 5 mgKOH/g or less).

Base oil 21: Ester of mixed fatty acid comprising fatty acid A and 3,5,5-trimethylhexanoic acid (mixing ratio (mass ratio): fatty acid A/3,5,5-trimethylhexanoic acid=70/30) and pentaerytiritol (complete ester content based on total amount of base oil: 95% by mass or greater, hydroxyl value: 5 mgKOH/g or less).

Base oil 22: Ester of mixed fatty acid comprising fatty acid B and n-decanoic acid (mixing ratio (mass ratio): fatty acid B/n-decanoic acid=75/25) and pentaerythritol (complete ester content based on total amount of base oil: 95% by mass or greater, hydroxyl value: 5 mgKOH/g or less).

Base oil 23: Ester of mixed fatty acid comprising fatty acid B and 3,5,5-trimethylhexanoic acid (mixing ratio (mass ratio): fatty acid B/3,5,5-trimethylhexanoic acid=75/25) and pentaerythritol (complete ester content based on total amount of base oil: 95% by mass or greater, hydroxyl value: 5 mgKOH/g or less).

Base oil 24: Ester of oleic acid and neopentyl glycol (complete ester content based on total amount of base oil: 95% by mass or greater, hydroxyl value: 5 mgKOH/g or less)

Base oil 25: Ester of mixed fatty acid comprising fatty acid A and n-decanoic acid (mixing ratio (mass ratio): fatty acid A/n-decanoic acid=60/40) and neopentyl glycol (complete ester content based on total amount of base oil: 95% by mass or greater, hydroxyl value: 5 mgKOH/g or less).

Base oil 26: Ester of mixed fatty acid comprising fatty acid A and 3,5,5-trimethylhexanoic acid (mixing ratio (mass ratio): fatty acid A/3,5,5-trimethylhexanoic acid=60/40) and neopentyl glycol (complete ester content based on total amount of base oil: 95% by mass or greater, hydroxyl value: 5 mgKOH/g or less).

Base oil 27: Ester of oleic acid and trimethylolpropane (complete ester content based on total amount of base oil: 95% by mass or greater, hydroxyl value: 5 mgKOH/g or less)

Base oil 28: Ester of mixed fatty acid comprising fatty acid A and n-decanoic acid (mixing ratio (mass ratio): fatty acid A/n-decanoic acid=60/40) and trimethylolpropane (complete ester content based on total amount of base oil: 95% by mass or greater, hydroxyl value: 5 mgKOH/g or less).

Base oil 29: Ester of mixed fatty acid comprising fatty acid A and 3,5,5-trimethylhexanoic acid (mixing ratio (mass ratio): fatty acid A/3,5,5-trimethylhexanoic acid=60/40) and trimethylolpropane (complete ester content based on total amount of base oil: 95% by mass or greater, hydroxyl value: 5 mgKOH/g or less).

Base oil 30: Ester of mixed fatty acid comprising 2-ethylhexanoic acid and 3,5,5-trimethylhexanoic acid (mixing ratio (mass ratio): 2-ethylhexanoic acid/3,5,5-trimethylhexanoic acid=50/50) and dipentaerythritol (complete ester content based on total amount of base oil: 95% by mass or greater, hydroxyl value: 5 mgKOH/g or less).

Base oil 31: Ester of oleic acid and pentaerythritol (complete ester content based on total amount of base oil: 95% by mass or greater, hydroxyl value: 5 mgKOH/g or less)

Base oil 32: Ester of stearic acid and pentaerythritol (complete ester content based on total amount of base oil: 95% by mass or greater, hydroxyl value: 5 mgKOH/g or less)

Base oil 33: Ester of mixed fatty acid comprising fatty acid A and n-decanoic acid (mixing ratio (mass ratio): fatty acid A/n-decanoic acid=60/40) and pentaerythritol (complete ester content based on total amount of base oil: 95% by mass or greater, hydroxyl value: 5 mgKOH/g or less).

Base oil 34: Ester of mixed fatty acid comprising fatty acid A and n-decanoic acid (mixing ratio (mass ratio): fatty acid A/n-decanoic acid=60/40) and di-(pentaerythitol) (complete ester content based on total amount of base oil: 95% by mass or greater, hydroxyl value: 5 mgKOH/g or less).

Base oil 35: Ester of mixed fatty acid comprising fatty acid A and 3,5,5-trimethylhexanoic acid (mixing ratio (mass ratio): fatty acid A/3,5,5-trimethylhexanoic acid=60/40) and pentaerythritol (complete ester content based on total amount of base oil: 95% by mass or greater, hydroxyl value: 5 mgKOH/g or less).

Base oil 36: Ester of mixed fatty acid comprising fatty acid A and 3,5,5-trimethylhexanoic acid (mixing ratio (mass ratio): fatty acid A/3,5,5-trimethylhexanoic acid=60/40)

and di-(pentaerythritol) (complete ester content based on total amount of base oil: 95% by mass or greater, hydroxyl value: 5 mgKOH/g or less).

Base oil 37: Ester of mixed fatty acid comprising fatty acid B and n-decanoic acid (mixing ratio (mass ratio): fatty acid B/n-decanoic acid=60/40) and pentaerythritol (complete ester content based on total amount of base oil: 95% by mass or greater, hydroxyl value: 5 mgKOH/g or less).

Base oil 38: Ester of mixed fatty acid comprising fatty acid B and 3,5,5-trimethylhexanoic acid (mixing ratio (mass ratio): fatty acid B/3,5,5-trimethylhexanoic acid=60/40) and di-(pentaerythritol) (complete ester content based on total amount of base oil: 95% by mass or greater, hydroxyl value: 5 mgKOH/g or less).

Base oil 39: Polypropyleneglycol monomethyl ether.

Each of the refrigerating machine oils obtained in Examples 1-23 and Comparative Examples 1-16 was subjected to an evaluation test in the following manner.

(Refrigerant Compatibility)

Following the method of JIS-K-2211, "Refrigerating machine Oils", "Appendix: Test Method For Compatibility With Refrigerants", 2 g of refrigerating machine oil was added to 2 g of carbon dioxide refrigerant, and it was observed whether the carbon dioxide refrigerant and refrigerating machine oil mutually dissolved at 0° C., assigning an evaluation of "compatible", "opaque" or "separated". The results are shown in Tables 2 to 6.

(Refrigerant Dissolved Viscosity)

The apparatus shown in FIG. 1 comprises a pressure vessel 5 (stainless steel, interior volume: 200 ml) that includes a viscometer 1, pressure gauge 2, thermocouple 3 and stirrer 4, a thermostatic bath 6 for temperature control in the pressure vessel 5, and a sampling cylinder 8 connected to the pressure vessel 5 through a flow channel 7 and including a valve. The sampling cylinder 8 and flow channel 7 are detachable, and the sampling cylinder 8 can be weighed during measurement, after vacuum deaeration, or after weighing out the carbon dioxide refrigerant and refrigerating machine oil mixture. The thermocouple 3 and thermostatic bath 6 are both electrically connected to temperature control means (not shown), and a data signal for the temperature of the sample oil (or mixture of carbon dioxide refrigerant and refrigerating machine oil) is sent from the thermocouple 3 to the temperature control means while a control signal is sent from the temperature control means to the thermostatic bath 6 to allow control of the temperature of the refrigerating machine oil or mixture. The viscometer 1 is electrically connected to an information processor (not shown), and measurement data for the viscosity of the fluid in the pressure vessel 5 is sent from the viscometer 1 to the information processor to allow measurement of the viscosity under prescribed conditions.

For this test, first 100 g of refrigerating machine oil was placed in the pressure vessel 5 and the vessel was vacuum deaerated, after which the carbon dioxide refrigerant was introduced and the mixture of the carbon dioxide refrigerant and refrigerating machine oil was stirred with a stirrer 4 and adjusted to 5 MPa at 40° C. while removing the refrigerant. After stabilization, the viscosity of the carbon dioxide refrigerant and refrigerating machine oil mixture was measured. The measurement results for the refrigerant dissolved viscosity at 40° C. are shown in Tables 2 to 6.

(Electrical Insulating Property (Volume Resistivity))

The volume resistivity of the refrigerating machine oil at 25° C. was measured according to JIS-C-2101, "Testing methods of electrical insulating oils". The results are shown in Tables 2 to 6.

(Thermostability (Total Acid Value))

After inserting and sealing 90 g of refrigerating machine oil, 10 g of carbon dioxide refrigerant and a catalyst (iron, copper and aluminum wires) in an autoclave, the mixture was heated to 200° C. and kept for 2 weeks. The total acid value of the refrigerating machine oil was measured after 2 weeks. The results are shown in Tables 2 to 6.

(Lubricity (Abrasion Wear Amount))

Running-in was performed for 1 minute under a load of 150 lb at a refrigerating machine oil temperature of 100° C., according to the ASTM D 2670 "FALEX WEAR TEST (Standard Test Method for Measuring Wear Properties of Fluid Lubricants (Falex Pin and Vee Block Method)". Next, the tester was operated for 2 hours under a load of 250 lb while blowing in 10 L/h of carbon dioxide refrigerant, and the abrasion wear of the test journal (pin) was measured after the test. The results are shown in Tables 2 to 6.

TABLE 2

| | | Example 1 | Example 2 | Example 3 | Example 4 | Comp. Ex. 1 | Comp. Ex. 2 | Comp. Ex. 3 |
|---|---|---|---|---|---|---|---|---|
| Base oil | | Base oil 1 | Base oil 2 | Base oil 3 | Base oil 4 | Base oil 24 | Base oil 25 | Base oil 26 |
| Kinematic viscosity at 40° C. ($mm^2/s$) | | 44.8 | 45.1 | 34.4 | 36.1 | 24.0 | 23.0 | 25.8 |
| Kinematic viscosity at 100° C. ($mm^2/s$) | | 8.0 | 8.1 | 6.6 | 6.7 | 5.9 | 5.0 | 5.1 |
| Fatty acid composition of ester | C14-C22 Branched fatty acids (% by mole) | 78.9 | 74.3 | 60.8 | 59.6 | 0 | 37.1 | 35.5 |
| | C16-C18 Branched fatty acids (% by mole) | 78.7 | 73.1 | 60.6 | 59.4 | 0 | 37 | 35.4 |
| | C18 Branched fatty acids (% by mole) | 74.1 | 65.4 | 57.1 | 56 | 0 | 34.9 | 33.3 |
| | C16-C18 Fatty acids (% by mole) | 88.4 | 82.1 | 68.1 | 66.8 | 100 | 41.6 | 39.7 |
| Proportion of tertiary carbon atoms among constituent carbon atoms of fatty acid (% by mass) | | 4.5 | 4.2 | 3.8 | 5.5 | 0 | 2.7 | 5.5 |
| Refrigerant compatibility test | | Compatible | Compatible | Compatible | Compatible | Compatible | Compatible | Compatible |
| Refrigerant dissolved viscosity at 40° C. ($mm^2/s$) | | 8.1 | 8.1 | 7.6 | 6.9 | 5.2 | 7.6 | 6.5 |
| Electrical insulating property (volume resistivity T Ωm) | | 8.5 | 10.2 | 9.3 | 7.5 | 2.1 | 9.4 | 5.7 |
| Stability (Acid value [mgKOH/g]) | | 0.42 | 0.38 | 0.35 | 0.45 | 1.21 | 0.43 | 0.53 |
| Lubricity (Abrasion wear amount[mg]) | | 13 | 13 | 14 | 15 | 27 | 21 | 34 |

TABLE 3

| | | Example 5 | Example 6 | Example 7 | Example 8 |
|---|---|---|---|---|---|
| Base oil | | Base oil 5 | Base oil 6 | Base oil 7 | Base oil 8 |
| Kinematic viscosity at 40° C. ($mm^2/s$) | | 72.0 | 71.5 | 71.9 | 59.6 |
| Kinematic viscosity at 100° C. ($mm^2/s$) | | 10.6 | 12.8 | 12.8 | 10.9 |
| Fatty acid composition of ester | C14-C22 Branched fatty acids (% by mole) | 50 | 78.9 | 74.3 | 60.8 |
| | C16-C18 Branched fatty acids (% by mole) | 50 | 78.7 | 73.1 | 60.6 |
| | C18 Branched fatty acids (% by mole) | 50 | 74.1 | 65.4 | 57.1 |
| | C16-C18 Fatty acids (% by mole) | 100 | 88.4 | 82.1 | 68.1 |
| Proportion of tertiary carbon atoms among constituent carbon atoms of fatty acid (% by mass) | | 2.9 | 4.5 | 4.2 | 3.8 |
| Refrigerant compatibility test | | Compatible | Compatible | Compatible | Compatible |
| Refrigerant dissolved viscosity at 40° C. ($mm^2/s$) | | 10 | 11 | 11 | 9.5 |
| Electrical insulating property (volume resistivity T Ωm) | | 10.5 | 11.8 | 11.9 | 8.5 |
| Stability (Acid value [mgKOH/g]) | | 0.25 | 0.28 | 0.31 | 0.27 |
| Lubricity (Abrasion wear amount [mg]) | | 12 | 11 | 12 | 13 |

| | | Example 9 | Comp. Ex. 4 | Comp. Ex. 5 | Comp. Ex. 6 |
|---|---|---|---|---|---|
| Base oil | | Base oil 9 | Base oil 27 | Base oil 28 | Base oil 29 |
| Kinematic viscosity at 40° C. ($mm^2/s$) | | 67.9 | 48.3 | 50.7 | 65.2 |
| Kinematic viscosity at 100° C. ($mm^2/s$) | | 11.6 | 9.2 | 9.5 | 10.8 |
| Fatty acid composition of ester | C14-C22 Branched fatty acids (% by mole) | 59.6 | 0 | 37.1 | 35.5 |
| | C16-C18 Branched fatty acids (% by mole) | 59.4 | 0 | 37 | 35.4 |
| | C18 Branched fatty acids (% by mole) | 56 | 0 | 34.9 | 33.3 |
| | C16-C18 Fatty acids (% by mole) | 66.8 | 100 | 41.6 | 39.7 |
| Proportion of tertiary carbon atoms among constituent carbon atoms of fatty acid (% by mass) | | 5.5 | 0 | 2.7 | 2.7 |
| Refrigerant compatibility test | | Compatible | Compatible | Compatible | Compatible |
| Refrigerant dissolved viscosity at 40° C. ($mm^2/s$) | | 8.9 | 8.1 | 6.2 | 5.3 |
| Electrical insulating property (volume resistivity T Ωm) | | 6.2 | 1.7 | 6.3 | 3.8 |
| Stability (Acid value [mgKOH/g]) | | 0.39 | 1.32 | 0.32 | 0.51 |
| Lubricity (Abrasion wear amount [mg]) | | 14 | 21 | 18 | 25 |

35

TABLE 4

| | | Example 10 | Example 11 | Example 12 | Example 13 |
|---|---|---|---|---|---|
| Base oil | | Base oil 10 | Base oil 11 | Base oil 12 | Base oil 13 |
| Kinematic viscosity at 40° C. ($mm^2/s$) | | 150 | 300 | 235 | 153 |
| Kinematic viscosity at 100° C. ($mm^2/s$) | | 18.7 | 29.3 | 24.1 | 18.8 |
| Fatty acid composition of ester | C14-C22 Branched fatty acids (% by mole) | 50 | 50 | 78.9 | 78.9 |
| | C16-C18 Branched fatty acids (% by mole) | 50 | 50 | 78.7 | 78.7 |
| | C18 Branched fatty acids (% by mole) | 50 | 50 | 74.1 | 74.1 |
| | C16-C18 Fatty acids (% by mole) | 100 | 100 | 88.4 | 88.4 |
| Proportion of tertiary carbon atoms among constituent carbon atoms of fatty acid (% by mass) | | 2.9 | 2.9 | 4.5 | 4.5 |
| Refrigerant compatibility test | | Compatible | Compatible | Compatible | Compatible |
| Refrigerant dissolved viscosity at 40° C. ($mm^2/s$) | | 20 | 28 | 26 | 21 |
| Electrical insulating property (volume resistivity T Ωm) | | 21.3 | 6.7 | 5.9 | 11.3 |
| Stability (Acid value [mgKOH/g]) | | 0.38 | 0.31 | 0.41 | 0.32 |
| Lubricity (Abrasion wear amount [mg]) | | 9 | 7 | 10 | 10 |

| | | Example 14 | Example 15 | Example 16 | Example 17 |
|---|---|---|---|---|---|
| Base oil | | Base oil 14 | Base oil 15 | Base oil 16 | Base oil 17 |
| Kinematic viscosity at 40° C. ($mm^2/s$) | | 277 | 238 | 154 | 282 |
| Kinematic viscosity at 100° C. ($mm^2/s$) | | 29.5 | 24.3 | 19.1 | 30.1 |
| Fatty acid composition of ester | C14-C22 Branched fatty acids (% by mole) | 78.9 | 74.3 | 74.3 | 74.3 |
| | C16-C18 Branched fatty acids (% by mole) | 78.7 | 73.1 | 73.1 | 73.1 |
| | C18 Branched fatty acids (% by mole) | 74.1 | 65.4 | 65.4 | 65.4 |
| | C16-C18 Fatty acids (% by mole) | 88.4 | 82.1 | 82.1 | 82.1 |
| Proportion of tertiary carbon atoms among constituent carbon atoms of fatty acid (% by mass) | | 4.5 | 4.2 | 4.2 | 4.2 |

TABLE 4-continued

| | | | | |
|---|---|---|---|---|
| Refrigerant compatibility test | Compatible | Compatible | Compatible | Compatible |
| Refrigerant dissolved viscosity at 40° C. ($mm^2/s$) | 27 | 26 | 21 | 27 |
| Electrical insulating property (volume resistivity T Ωm) | 7.8 | 6.5 | 10.7 | 9.2 |
| Stability (Acid value [mgKOH/g]) | 0.42 | 0.35 | 0.3 | 0.29 |
| Lubricity (Abrasion wear amount [mg]) | 8 | 9 | 10 | 7 |

TABLE 5

| | | Example 18 | Example 19 | Example 20 | Example 21 |
|---|---|---|---|---|---|
| Base oil | | Base oil 18 | Base oil 19 | Base oil 20 | Base oil 21 |
| Kinematic viscosity at 40° C. ($mm^2/s$) | | 131 | 149 | 111 | 144 |
| Kinematic viscosity at 100° C. ($mm^2/s$) | | 16.8 | 17.9 | 14.9 | 17.0 |
| Fatty acid composition of ester | C14-C22 Branched fatty acids (% by mole) | 60.8 | 59.6 | 45.8 | 44.2 |
| | C16-C18 Branched fatty acids (% by mole) | 60.6 | 59.4 | 45.7 | 44 |
| | C18 Branched fatty acids (% by mole) | 57.1 | 56 | 43 | 41.5 |
| | C16-C18 Fatty acids (% by mole) | 68.1 | 66.8 | 51.3 | 49.5 |
| Proportion of tertiary carbon atoms among constituent carbon atoms of fatty acid (% by mass) | | 3.8 | 5.5 | 3.2 | 6.5 |
| Refrigerant compatibility test | | Compatible | Compatible | Compatible | Compatible |
| Refrigerant dissolved viscosity at 40° C. ($mm^2/s$) | | 18 | 16 | 14 | 13 |
| Electrical insulating property (volume resistivity T Ωm) | | 10.4 | 9.5 | 10.2 | 9.4 |
| Stability (Acid value [mgKOH/g]) | | 0.28 | 0.35 | 0.25 | 0.34 |
| Lubricity (Abrasion wear amount[mg]) | | 10 | 11 | 8 | 12 |

| | | Example 22 | Example 23 | Comp. Ex. 7 | Comp. Ex. 8 |
|---|---|---|---|---|---|
| Base oil | | Base oil 22 | Base oil 23 | Base oil 30 | Base oil 31 |
| Kinematic viscosity at 40° C. ($mm^2/s$) | | 118 | 147 | 220 | 68.0 |
| Kinematic viscosity at 100° C. ($mm^2/s$) | | 15.7 | 17.6 | 18.1 | 12.2 |
| Fatty acid composition of ester | C14-C22 Branched fatty acids (% by mole) | 46.2 | 44.7 | 0 | 0 |
| | C16-C18 Branched fatty acids (% by mole) | 45.4 | 44 | 0 | 0 |
| | C18 Branched fatty acids (% by mole) | 40.7 | 40 | 0 | 0 |
| | C16-C18 Fatty acids (% by mole) | 51 | 50 | 0 | 100 |
| Proportion of tertiary carbon atoms among constituent carbon atoms of fatty acid (% by mass) | | 2.9 | 6.3 | 12.1 | 0 |
| Refrigerant compatibility test | | Compatible | Compatible | Compatible | Compatible |
| Refrigerant dissolved viscosity at 40° C. ($mm^2/s$) | | 15 | 14 | 7 | 11 |
| Electrical insulating property (volume resistivity T Ωm) | | 8.7 | 7.5 | 4.5 | 2.8 |
| Stability (Acid value [mgKOH/g]) | | 0.3 | 0.33 | 0.53 | 1.03 |
| Lubricity (Abrasion wear amount[mg]) | | 9 | 11 | 19 | 20 |

45

TABLE 6

| | | Comp. Ex. 9 | Comp. Ex. 10 | Comp. Ex. 11 | Comp. Ex. 12 |
|---|---|---|---|---|---|
| Base oil | | Base oil 32 | Base oil 33 | Base oil 34 | Base oil 35 |
| Kinematic viscosity at 40° C. ($mm^2/s$) | | Solid | 97.7 | 184 | 141 |
| Kinematic viscosity at 100° C. ($mm^2/s$) | | — | 13.6 | 22.1 | 16.3 |
| Fatty acid composition of ester | C14-C22 Branched fatty acids (% by mole) | 0 | 37.1 | 37.1 | 35.5 |
| | C16-C18 Branched fatty acids (% by mole) | 0 | 37 | 37 | 35.4 |
| | C18 Branched fatty acids (% by mole) | 0 | 34.9 | 34.9 | 33.3 |
| | C16-C18 Fatty acids (% by mole) | 100 | 41.6 | 41.6 | 39.7 |
| Proportion of tertiary carbon atoms of constituent carbon atoms of fatty acid (% by mass) | | 0 | 2.7 | 2.7 | 5.5 |
| Refrigerant compatibility test | | Compatible | Compatible | Compatible | Compatible |
| Refrigerant dissolved viscosity at 40° C. ($mm^2/s$) | | — | 12 | 23 | 9.1 |
| Electrical insulating property (volume resistivity T Ωm) | | — | 8.5 | 6.3 | 4.5 |
| Stability (Acid value [mgKOH/g]) | | — | 0.38 | 0.41 | 0.45 |
| Lubricity (Abrasion wear amount [mg]) | | — | 17 | 15 | 24 |

TABLE 6-continued

| | | Comp. Ex. 13 | Comp. Ex. 14 | Comp. Ex. 15 | Comp. Ex. 16 |
|---|---|---|---|---|---|
| Base oil | | Base oil 36 | Base oil 37 | Base oil 38 | Base oil 39 |
| Kinematic viscosity at 40° C. ($mm^2/s$) | | 304 | 98.6 | 142 | 150 |
| Kinematic viscosity at 100° C. ($mm^2/s$) | | 28.6 | 13.8 | 16.5 | 24.9 |
| Fatty acid composition of ester | C14-C22 Branched fatty acids (% by mole) | 35.5 | 34.9 | 33.3 | — |
| | C16-C18 Branched fatty acids (% by mole) | 35.4 | 34.3 | 32.8 | — |
| | C18 Branched fatty acids (% by mole) | 33.3 | 30.7 | 29.3 | — |
| | C16-C18 Fatty acids (% by mole) | 39.7 | 38.5 | 36.8 | — |
| Proportion of tertiary carbon atoms of constituent carbon atoms of fatty acid (% by mass) | | 2.7 | 2.5 | 7 | — |
| Refrigerant compatibility test | | Compatible | Compatible | Compatible | Compatible |
| Refrigerant dissolved viscosity at 40° C. ($mm^2/s$) | | 13 | 13 | 12 | 22 |
| Electrical insulating property (volume resistivity T Ωm) | | 1.3 | 4.2 | 2.1 | $3.2 \times 10^{-4}$ |
| Stability (Acid value [mgKOH/g]) | | 0.47 | 0.3 | 0.52 | 2.54 |
| Lubricity (Abrasion wear amount [mg]) | | 18 | 19 | 15 | 24 |

As seen by the results in Tables 2 to 6, the refrigerating machine oils of Examples 1-23, when used with a carbon dioxide refrigerant, exhibited an excellent balance of performance in terms of lubricity, refrigerant compatibility, thermostability, electrical insulating properties and kinematic viscosity. In particular, the refrigerating machine oils of Examples 1-23 exhibited excellent lubricity in the presence of a carbon dioxide refrigerant, compared to the refrigerating machine oils of the comparative examples that had similar refrigerant dissolved viscosities at 40° C.

Industrial Applicability

The present invention provides a useful refrigerating machine oil and base oil for a refrigerating machine oil, to be used together with a carbon dioxide refrigerant.

The invention claimed is:

1. A refrigerating machine fluid composition comprising:

a refrigerating machine oil comprising a complete ester of a fatty acid wherein a proportion of C14-C22 branched fatty acid is 40-100% by mole, and a polyhydric alcohol; and a refrigerant containing carbon dioxide.

2. A refrigerating machine fluid composition according to claim 1, wherein the polyhydric alcohol has 2-6 hydroxyl groups.

3. A refrigerating machine fluid composition according to claim 1, wherein a proportion of C16-C18 fatty acids in the fatty acid is 40-100% by mole.

4. A refrigerating machine fluid composition according to claim 1, wherein the proportion of C16-C18 branched fatty acids in the fatty acid is 40-100% by mole.

5. A refrigerating machine fluid composition according to claim 1, wherein a proportion of C18 branched fatty acids in the fatty acid is 50-100% by mole.

6. A refrigerating machine fluid composition according to claim 1, wherein a proportion of tertiary carbon atoms among constituent carbon atoms of the fatty acid is 2% by mass or greater, as determined by $^{13}C$—NMR analysis.

* * * * *

UNITED STATES PATENT AND TRADEMARK OFFICE

CERTIFICATE OF CORRECTION

PATENT NO. : 7,993,543 B2
APPLICATION NO. : 12/293846
DATED : August 9, 2011
INVENTOR(S) : Kazuo Tagawa et al.

It is certified that error appears in the above-identified patent and that said Letters Patent is hereby corrected as shown below:

Title page, item (54) and col. 1, line 1-3, delete the title "REFRIGERATING MACHINE OIL FOR CARBON DIOXIDE REFRIGERANT" and replace with --BASE OIL OF REFRIGERATING MACHINE OIL FOR CARBON DIOXIDE REFRIGERANT AND REFRIGERATING MACHINE OIL FOR CARBON DIOXIDE REFRIGERANT--.

Signed and Sealed this
Thirteenth Day of December, 2011

David J. Kappos

David J. Kappos
*Director of the United States Patent and Trademark Office*